US008593303B2

(12) United States Patent
Jacobs et al.

(10) Patent No.: US 8,593,303 B2
(45) Date of Patent: Nov. 26, 2013

(54) REFLECTOR POLE

(75) Inventors: Joseph Hendrik Anna Maria Jacobs, Eygelshoven (NL); Dirk Hente, Wuerselen (DE)

(73) Assignee: Koninklijke Philips N.V., Eindhoven (NL)

( * ) Notice: Subject to any disclaimer, the term of this patent is extended or adjusted under 35 U.S.C. 154(b) by 722 days.

(21) Appl. No.: 12/810,518

(22) PCT Filed: Dec. 17, 2008

(86) PCT No.: PCT/IB2008/055360

§ 371 (c)(1), (2), (4) Date: Jun. 25, 2010

(87) PCT Pub. No.: WO2009/087513

PCT Pub. Date: Jul. 16, 2009

(65) Prior Publication Data

US 2010/0277344 A1 Nov. 4, 2010

(30) Foreign Application Priority Data

Jan. 4, 2008 (EP) ..... 08100085

(51) Int. Cl.
*G08G 1/095* (2006.01)

(52) U.S. Cl.
USPC ..... 340/944; 340/905; 340/907; 340/539.1; 340/539.23

(58) Field of Classification Search
USPC ..... 340/944, 907, 906, 905, 901, 539.1, 340/539.23, 332; 362/183, 368, 328, 329; 116/1, 63
See application file for complete search history.

(56) References Cited

U.S. PATENT DOCUMENTS

| | | | | |
|---|---|---|---|---|
| 4,668,120 | A | 5/1987 | Roberts | |
| 5,074,706 | A * | 12/1991 | Paulos | 404/12 |
| 6,579,035 | B1 * | 6/2003 | Watson | 404/14 |
| 7,980,782 | B2 * | 7/2011 | Bleiner et al. | 404/9 |
| 8,328,375 | B2 * | 12/2012 | Diekmann et al. | 362/84 |
| 2004/0217702 | A1 | 11/2004 | Garner et al. | |
| 2005/0244225 | A1 * | 11/2005 | Jordan | 404/16 |
| 2005/0270175 | A1 | 12/2005 | Peddie et al. | |
| 2007/0209244 | A1 | 9/2007 | Prollius et al. | |

FOREIGN PATENT DOCUMENTS

| | | | |
|---|---|---|---|
| DE | 19927752 | A1 | 1/2001 |
| EP | 0305905 | A2 | 3/1989 |
| WO | 03004777 | A1 | 1/2003 |
| WO | 2008122920 | A2 | 10/2008 |
| WO | 2009034301 | A2 | 3/2009 |

* cited by examiner

*Primary Examiner* — Hung T. Nguyen
(74) *Attorney, Agent, or Firm* — David Zivan; Mark Beloborodov

(57) ABSTRACT

The invention relates to a Reflector pole (1), which is used as a road marker, a road boundary, a sign pole or for similar applications related to road or pedestrian traffic, comprising a main body (2), featuring at least one light active field (3). According to the invention the light active field (3) comprises an organic light emitting diode (OLED) (4).

13 Claims, 2 Drawing Sheets

REFLECTOR POLE

FIELD OF INVENTION

The present invention relates to a reflector pole, which is used as a road marker, a road boundary, a sign pole or for similar applications related to road or pedestrian traffic, comprising a main body, featuring at least on light active field.

BACKGROUND OF THE INVENTION

Usually these reflector poles are used along the highway and in residential areas. A great many of these reflector poles are positioned along roads, highways or pedestrian footpaths. The poles are positioned in constant distances to each other, whereas the light active field is performed as a retro-reflective field. They are taught to mark the road and to improve the drive comfort. The colour of the retro-reflective field may be different depending on the driving direction for vehicles or depending on the left or right side of the highway. Usual reflector poles, which are used in residential area, feature a red or a white retro-reflective field.

A basic drawback of this kind of reflector poles is the passive behaviour of the light active field, which is performed as a retro-reflective field. Only in the case, if incident light is directed onto the reflector field, the reflector reflects a re-light. When a vehicle is oncoming, their headlights illuminate the retro-reflective field, which is visible for the driver of the vehicle. Oncoming pedestrians, who do not have any light source, may not take any notice of the presence of the reflector poles. Against this background of the passive behaviour of usual retro-reflective fields, light active fields are known which comprise active light sources.

The U.S. Pat. No. 4,668,120 discloses a reflector element for traffic application, comprising a main body, which may be secured to a highway or alternatively, to a vertical wall. Within this main body a light active field is applied, which may reflect light in a predetermined direction towards the highway traffic. Within this light active field, a light source is integrated in order to emit active light by the reflector pole. Moreover, a battery and a photo voltaic system are provided, in order to avoid the installation of many kilometres of cables to supply all the poles with electrical power. Thus, the reflector poles are performed as self-sustaining units without any external power supply. The light source is performed as a light emitting diode (LED), which is unfortunately a point-shaped light source. Combinations between LEDs and reflectors feature a reflector field, which may be performed as a cube corner array, and in which a matrix of LEDs is integrated. Indeed, in the prior art is known a combination between a retro-reflector element and active light sources, but unfortunately the number of LEDs feature an inhomogeneous emission behaviour, because the light emission is performed by an accumulation of a quantity of single point light sources. Moreover, the reflector field is interrupted by the positions of the LEDs, and that leads to an inhomogeneous reflective behaviour of the retro-reflector. Moreover, a high number of LEDs consume a high quantity of electrical power, which leads to a higher request of the delivery of electrical energy.

SUMMARY OF THE INVENTION

An objective of the invention is to eliminate the above mentioned disadvantages. In particular it is an objective of the present invention to provide a reflector pole with an improved retro-reflective behaviour in combination with a homogeneous square emission of light.

This objective is achieved by a reflector pole suitable to be used as a road marker, a road boundary, a sign pole or for similar applications related to road or pedestrian traffic, comprising a main body, featuring at least one light active field, characterised in that the light active field comprises an organic light emitting diode (OLED). A preferred embodiment of the invention is defined by the subclaims.

The invention discloses that the light active field comprises an organic light emitting diode (OLED).

OLEDs are performed as square or field emitters, which emit homogeneous light across the whole field. Organic light emitting diodes are light emitting diodes, whose emissive electroluminescent layer is composed of a film of organic compounds. The layer is performed as a carrier or a substrate, which may be bended or which is at least flexible. Thus, the OLED may be applied on the surface of uneven surfaces, like the surface of the main body of a reflector pole.

Due to the square emission of the OLED the dimension of the OLED may be adapted to the predetermined dimension of a light active field of a reflector pole, which is used in the public traffic. In the purpose of the present invention the light active field features a retro-reflective behaviour beyond the OLED compound.

As a preferred embodiment of the present invention the OLED is performed as a retro-reflective OLED compound, comprising an OLED and a retro-reflective membrane. As a first embodiment of the compound between the OLED and the retro-reflective membrane, the membrane is transparent for the light, which is emitted by the OLED. Thus, the membrane is applied on the surface of the OLED and forms the outer surface of the light active field, which is a part of the surface of the main body. According to another embodiment, the retro-reflective membrane may be applied behind the OLED, in order to form the OLED as the outer surface of the light active field. In this case, the OLED is transparent for the incident light, which is directed onto the reflector, respectively the re-lighting of the reflector. The substrate of the OLED may be a glass substrate or a polymer-substrate, which can be transparent. Additionally, the OLED features at least two electrode layers, which may be performed transparent too. Thus, the OLED can be performed as a through-shining element, but is able to emit light for itself. The light, which is emitted towards the retro-reflective membrane, may be reflected as well as the light, which is emitted by an external light source like the headlights of a vehicle. Thus, the present invention proposes a light active field with a retro-reflecting behaviour combined with a self-shining property, whereas both the retro-reflective area and the self-shining area are homogeneous and super imposed.

According to another embodiment of the present invention, the retro-reflective OLED features a specific colour. The colour emitted by the OLED corresponds to the colour reflected by the retro-reflective membrane. Reflector poles, which are used in the public traffic, have to meet specific colour requirements of the light active fields. The colours may be different for different countries. Known colours are red, green, orange, yellow or white. Next to the colours with specific requirements the dimensions of the light active fields may meet different specifications, which are required by law. As an advantage the colour, which is reflected by the membrane and the colour, and which is emitted by the OLED, may be the same colour, whereas otherwise the colour, which is emitted by the OLED, may deviate from the colour, which is reflected by the membrane. For example if a reflector pole with a light active field is used for a passive traffic pole, which is reflecting green colour, may emit red colour, in order to advise the driver of the vehicle against an accident or e.g. a traffic jam. In another application, green reflective membranes may change the colour into red active emitting fields, if a pedestrian is close to the reflector pole. Thus, the driver of the vehicle is advised, that a pedestrian is close to or on the highway. In these applications a variation between the colour, reflected by the membrane and the colour, emitted by the OLED, is meaningful and beneficial for safety in public traffic.

According to another preferred embodiment the membrane is arranged parallel adjacent to the OLED, whereas the membrane features transreflective characteristics. The OLED may feature a light out coupling side, whereas the emitted light generated by the OLED, passes the out coupling side, whereas the retro-reflective membrane is laminated onto the out coupling side of the OLED. The membrane may consist of a polymer foil, whereas the retro-reflective behaviour can be generated by different physical effects.

According to a first retro-reflection effect, the retro-reflective membrane features a micro-structured surface. A ray of light shining on the surface is reflected back on a parallel path. The retro-reflective membrane may be produced from any transparent material having a micro-structure with three mutular-perpendicular planes. This micro-structure is well known as so called cat eye, which may be manufactured by plastic moulding or hot embossing. Thus, the surface may be formed as a cube corner array, which features a retro-reflective behaviour at both sides of the membrane, whereas only one side of the membrane features the array. The membrane may feature a front side, which can be flat bonded by a cover layer onto the retro-reflective base layer. The bonding area is preferably transparent. By bonding said layer the membrane features a protective coating against environmental impact.

If the surface, formed by said cube corner array is not transparent, it is intended to form the micro-structured surface within the retro-reflective membrane in a partially and discreet way. The micro-structured surfaces within the membrane, alternate with transparent areas, in order to enable a transmission of the light, emitted by the OLED, which is arranged adjacent to the membrane. The alternating between the structured surface area and the transparent area can be performed in a rectangular matrix, in stripes or e.g. in circular openings. The alternating may be performed in small distances, in order to avoid an appearance of the alternating for drivers of vehicles or pedestrians. In continuation of another improvement of the compound of an OLED and a reflecting membrane the areas of the OLED, which are covered by a micro-structured surface within the membrane, these areas may be performed as dark areas within the OLED surface. Thus, the energy consumption of the OLED is reduced and the compound features a lowered loss of energy.

According to another embodiment the reflective membrane comprises microspheres and/or micro structure elements. Microspheres and/or micro structure elements, which are contained within a retro-reflective membrane, leads to a retro-reflective effect, generated by the microspheres. Due to a diffusion effect, the light, which is generated by the OLED behind the membrane comprising the microspheres, the microspheres or the micro structure elements activate the transmission of the light. The light appears in a higher brightness, because the microspheres or the micro structure elements within the light transmitting membrane lead to an optical alignment of the transmitted light.

In its preferred embodiment the out coupling side of the OLED is performed by an electrode layer, featuring a higher reflective surface, in order to provide an independent retro-reflecting behaviour of the OLED itself. In combination with the membrane, the retro-reflecting characteristic may be supported. OLEDs feature electrode layers, which may consist of aluminium or e.g. ITO (Indium-Tin-Oxide). These electrode layers may be performed as high reflective layers like a mirror, whereas the mirror effect may support the retro-reflective effect of the membrane, which is laminated on the surface of the OLED.

In order to supply electrical power to the OLED, the main body contains an electric storage device. The electric storage device may be performed as a battery, an accumulator and/or a capacitor. The storage device is electrically connected to the OLED, whereas the capacity of the electric storage device is sufficient to operate the OLED at least a whole night long or during an extended period of darkness, which may depend on e.g. the weather or the season. Modern capacitors feature a high capacity, which are known as so called super capacitors.

The main body of the reflector pole usually is performed as a hollow body with an interior space. This interior space is big enough to contain a number of electrical components, which are mounted on the inner wall of the main body.

In order to provide an energy source for charging the electric storage device, a photovoltaic or a wind turbine device is applied on the main body. It is preferred to provide the photovoltaic device on the top side of the main body, in order to achieve a maximum of incident solar radiation. According to another embodiment, a number of reflector poles may be power supplied by a single photo voltaic device, which is performed as a solar cell. The solar cell, which e.g. may be applied at every second or every fourth or fifth reflector pole delivers the electrical power to the neighboured reflector poles by wire.

Yet another embodiment of the present invention provides a main body, in which is contained a control unit, in order to control at least the charging of the electrical storage device and/or the power supply to the OLED, in order to adjust at least the brightness or the colour of the emitted light. As well as the OLED itself the control unit is power supplied by the photovoltaic device. The control unit may be performed to control the whole scope of functions, featured by the reflector pole. Thus, the control unit features an electrical connection to each electrical device in its periphery.

Advantageously, the main body contains a proximity sensor, in order to detect approaching vehicles and/or approaching passengers. The proximity sensor may interact with the control unit, whereas in case of detecting an approaching vehicle or an approaching passenger, the control unit switches on the OLED. When the distance between the vehicle and the passenger increases again and reaches a certain distance, the control unit may switch off the OLED. By this function the OLED of the reflector pole is only switched on, if a vehicle or a pedestrian is close to the reflector pole or close to at least a number of reflector poles. Thus, the OLEDs are not activated without any sense and the energy, stored in the energy storage device may be saved.

According to yet another embodiment the main body features at least one communication device and in particular a RFID-communication device. By applying a RFID-communication device a communication to other reflector poles, to a vehicle or to pedestrians is possible, if the vehicle or the pedestrian is provided with a transponder, in order to interact with the RFID-communication device within the reflector pole. In continuation of another improvement of the embodiment, the RFID-communication device may communicate to an external service device. Thus, the control unit may communicate service data via the RFID-communication device to an external service device, which may be installed e.g. within a service vehicle, driving along the highway and which is collecting data from reflector pole to reflector pole. These data may comprise information about the state of the electrical storage device or the power supply by the photo voltaic device. In case of a failure, which may be stored in a kind of failure protocol, provided by the control unit, a service can be made for each reflector pole, if necessary.

In the present invention also is embodied a light sensor for detecting day or night time, whereas the light sensor is integrated or connected with the control unit. By use of a light sensor the information about darkness may be delivered to the control unit, in order to switch on the OLED depending on the darkness. Thus, the OLED may only be activated, when it is necessary, and to avoid an activation of the OLED during the day.

Advantageously the OLED (4) is performed as a bicolour or a multicolour OLED (4), whereas the OLED (4) emits at least a first colour on one side and at least a second colour at the opposite side. The first side of the OLED is e.g. the top side and the second side is the bottom side, whereas at both sides light is emitted with different colours. Thus, the light active field may be applied in reverse positions, in order to perform different colours relating to the traffic need. For instance a red emitting side and a white emitting side may be performed, whereas the colour can be defined by the side, which the active side of the field.

According to yet another embodiment the control unit features a traffic jam detection and a traffic jam warning OLED, whereas the traffic jam warning OLED is activated in case of a traffic jam. By this feature the avoidance of accidents may be improved, because the driver of the vehicle can be warned in case of an accident, whereas the warning happens a few metres or some hundred metres in front of the point of the accident.

Additional details, characteristics and advantages of the objective of the invention are disclosed in the depending claims and the following description of the respective figures, which are only shown in an exemplary fashion.

BRIEF DESCRIPTION OF THE DRAWINGS

The figures show preferred embodiments of the invention, which will be described in conjunction with the accompanying figures in which.

DETAILED DESCRIPTION OF EMBODIMENTS

Figure 1:
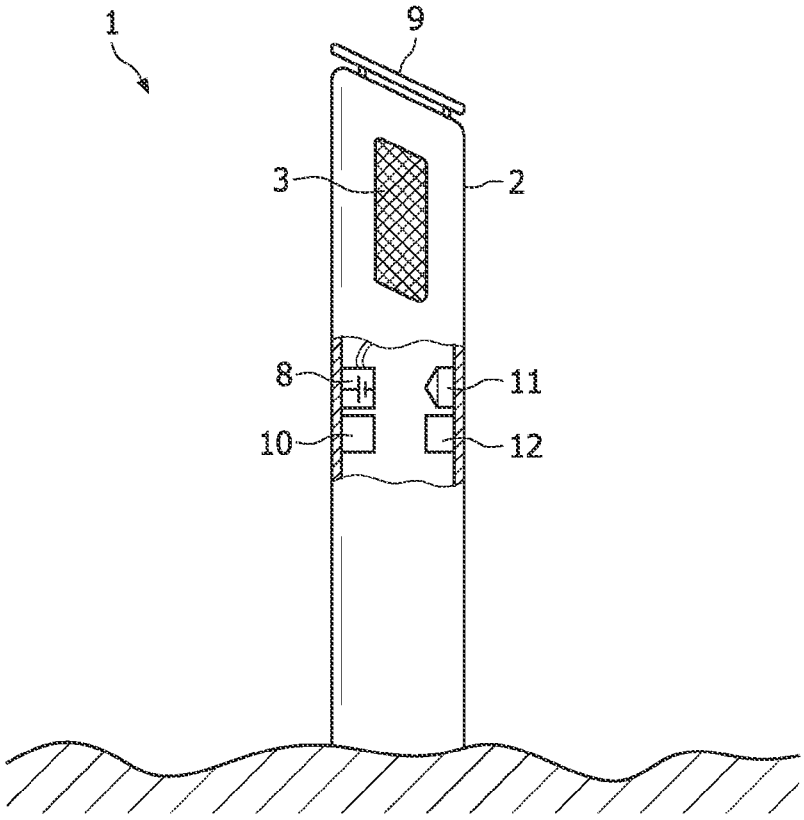
FIG. 1 shows an embodiment of the present invention in an exemplary fashion, whereas the main body of the reflector pole is cross-sectioned in order to visualise the internal features.

The reflector pole 1 shown in FIG. 1 corresponds to an embodiment of the present invention. The reflector pole 1 may be used as a road marker, a road boundary, a sign pole or as a delineator. The reflector pole 1 may also be performed as a reflector cap, which can be inserted into the highway pavement or which can be secured to a vertical surface or a wall. The reflector pole 1 comprises a main body 2, which is usually manufactured by plastic-moulding. The main body 2 features an internal cavity, in which several components may be contained. On the surface of the main body 2 is applied a light active field 3, which is according to the present invention performed as an organic light emitting diode (OLED) and is compound with a retro-reflective membrane. The detailed construction of the light active field 3 is shown in the following figures.

Within the internal cavity of the main body 2 is contained an electric storage device 8, which may be performed as a battery, an accumulator or as a capacitor. Thus, the electric storage device 8 features a battery symbol and is connected to the light active field 3 by wire. Next to the electric storage device 8 a control unit 10 is integrated within the main body 2. The control unit 10 is performed to control the functions of the entire reflector pole 1. In particular the control unit 10 may control the charging of the electric storage device 8 or the power supply to the OLED, which is a part of the light active field 3. Next to the control unit 10 a proximity sensor 11 and a communication device 12 is integrated within the main body 2. The proximity sensor 11 is intended to detect approaching vehicles or approaching pedestrians. The communication device 12 is intended to communicate with other reflector poles 1 or with a vehicle, a pedestrian or an external service device, which comprises a transponder for communication with the RFID-device. The communication device 12 can be performed to communicate via a ZIGBEE-protocol which is feasible for exchange several certain data between two communication devices. On the top side of the main body 2 a photovoltaic device 9 is applied. The device 9 is intended to charge the electric storage device 8 or to operate the light active field 3 by a direct wire connection, respectively under the control of the control unit 10. The photo voltaic device 9 is performed as a solar cell, in order to deliver electric energy by using incident solar radiation, which is shining onto the photovoltaic device.

Figure 2:
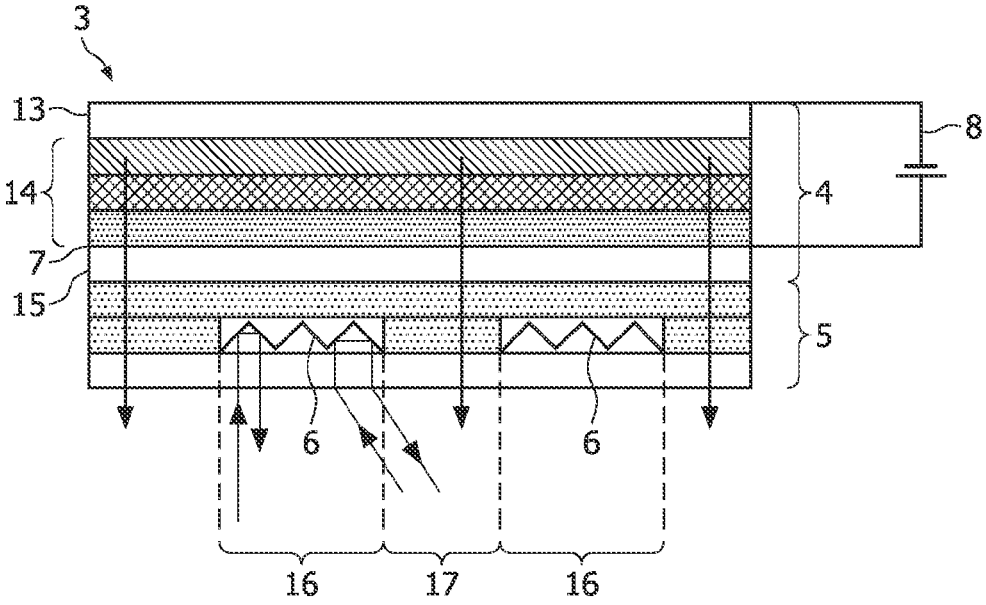
FIG. 2 a first embodiment of the light active field comprising an OLED and a membrane with a first direction of cube corner arrays.

FIG. 2 shows an embodiment of the light active field 3, which is composed of an organic light emitting diode 4 and a retro-reflective membrane 5. An OLED 4 comprises a first electrode layer 7 and a second electrode layer 13. Between the electrode layers 7 and 13 are arranged several layers, which comprise at least a fluorescent and/or phosphorescent emitter layer, a whole blocking layer, an electron transport layer and/or additionally an electron injection layer, whereas these layers feature a thickness of approximately 5 nm to 100 nm and are numbered with 14. The light, which is emitted by the emitter layers 14 is indicated by three arrows, which are passing the retro-reflective membrane 5. The OLED 4 is arranged on a glass substrate 15, which is performed as a kind of carrier for the whole light active field 3. At the opposite side of the glass substrate 15 the retro-reflective membrane 5 is arranged. The OLED 4 is performed as a bottom-emitting OLED, because the light, emitted by the emitter layers 14 passes through the glass substrate 15, which forms the bottom of the device. The retro-reflective membrane 5 features structured surface areas 16, which alternate with transparent areas 17. The light, which is generated by the OLED 4 may pass through the retro-reflective membrane 5 via the transparent areas 17. Incident light, shining onto the surface of the retro-reflective membrane 5, may retroreflect in the micro structured surface areas 16. The reflection of the incident light is indicated by arrows, which include different angles related to the surface of the membrane 5. Depending on the angle the incident light, which is shining onto the retro-reflective membrane 5, leaves the membrane 5 into the same direction under the same angle to the surface. This effect is achieved by micro structured surface 16, which are provided with cube corner arrays 6.

Figure 3:
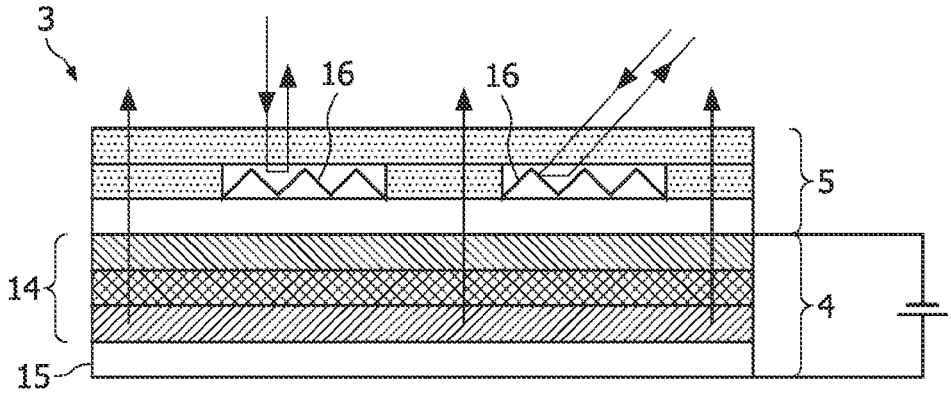
FIG. 3 an embodiment of the light active field comprising an OLED and a membrane with a second alignment of cube corner array, FIG. 4 an embodiment of an OLED-retro-reflective-membrane-compound, whereas the membrane comprises microspheres and FIG. 5 an embodiment of the compound comprising an OLED and a retro-reflective membrane with a transflective foil, which is used as a device ceiling.

FIG. 3 shows another embodiment of the compound comprising an OLED and a retro-reflective membrane 5. In this embodiment the OLED 4 is performed as a top-emission-OLED, because the light generated within the emitter layers 14 is not passing via the glass substrate 15, but via the top side of the OLED 4. Thus, the retro-reflective membrane 5 is deposited onto the top side of the OLED 4, and the glass substrate 15 forms the bottom of the entire light active field 3. The membrane 5 comprises a transreflective foil, which can be formed by different laminated layers. The micro structured surface 16 comprises a cat-eye surface with mutular-perpendicular planes. These planes feature a transfer between different refractive indexes, whereas e.g. the material-transition may be a synthetic material to air. As well as in the embodiment regarding FIG. 2 the micro structured surface 16 alternates between transparent areas, which are transparent for the light, generated in the organic light emitting diode 4.

Figure 4:
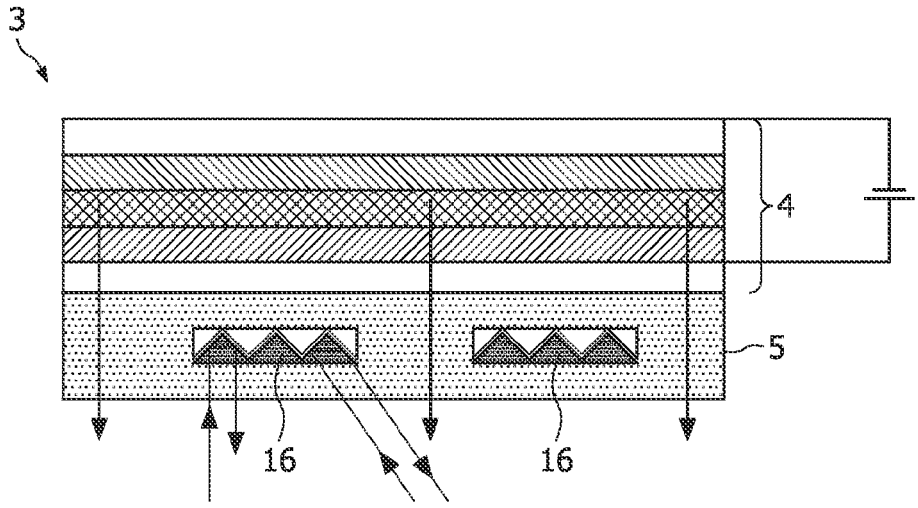

FIG. 4 shows another embodiment of a light active field 3, whereas said light active field 3 comprises an organic light emitting diode 4 and a retro-reflective membrane 5. The retro-reflective membrane 5 comprises a transflective foil, which is laminated onto the OLED 4. Within said foil are inserted micro particles or microspheres, by which a reflecting effect may be achieved. Within this transflective foil with the micro particles micro structured surfaces 16 are inserted, in order to enforce the reflecting effect. The material of the transflective foil is able to be transparent for the light of the OLED 4 and which is also suited to reflect the light, which shines onto the field 3.

Figure 5:
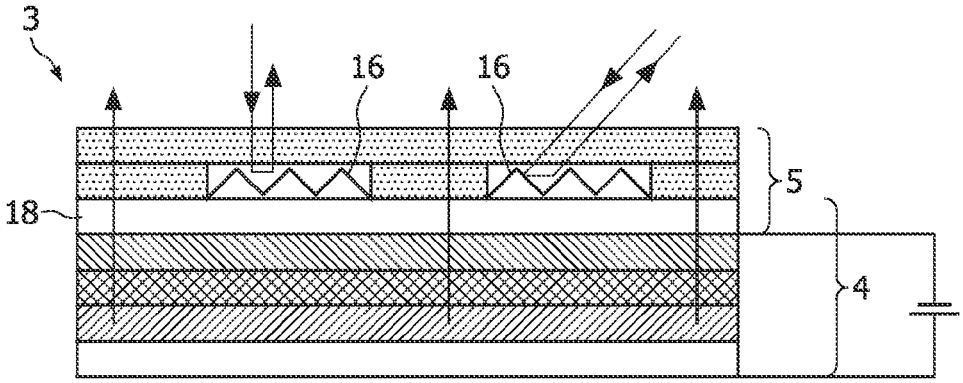

In FIG. 5 is shown another embodiment of the light active field 3, comprising an OLED 4 and a membrane 5, whereas the membrane 5 features a ceiling layer 18. In this embodiment the transflective foil is used as a ceiling device, whereas the other layers of the membrane 5 may be performed as transflective foils with micro particles, in order to provide a retro-reflecting effect.

The present invention is not limited by the embodiment described above, which is represented as an example only and can be modified in various ways within the scope of the protection defined by the appending patent claims. Thus, the invention is also applicable by combining the different embodiments of the light active field 3, comprising different kinds of organic emitting diodes 4 and membranes 5. Each kind of OLED 4, which may comprise top emitting OLEDs and bottom emitting OLEDs, can be combined with each kind of membrane 5, which may comprise only micro structured surfaces 16 or only a transflective foil comprising micro particles. Also a combination of microspheres comprising transflective foils with micro structured surfaces 16 are able to be combined with every different of OLEDs 4 within the scope of the present invention.

LIST OF NUMERALS

1 reflector pole
2 main body
3 light active field
4 organic light emitting diode
5 retro reflective membrane
6 cube corner array
7 electrode layer
8 electric storage device
9 photo voltaic device
10 control unit
11 proximity sensor
12 communication device
13 electrode layer
14 emitter layers
15 glass substrate
16 micro structured surface
17 transparent area
18 sealing layer

The invention claimed is:

1. A reflector pole used as a road boundary for road of pedestrian traffic, the pole comprising:

a main body having at least one light active field comprising a retro reflective compound including an organic light emitting diode (OLED) and a retro reflective membrane, wherein the retro reflective membrane includes a plurality of reflective micro structured surfaces that are disposed directly over the OLED such that light from the OLED is emitted around a plurality of sides of a given reflective micro structured surface of the plurality of reflective micro structured surfaces.

2. The reflector pole according to claim 1, wherein the retro reflective compound generates a predetermined colour, wherein the colour emitted by the OLED corresponds to the colour reflected by the retro reflective membrane.

3. The reflector pole according to claim 1, wherein the retro reflective membrane is at transreflective and is arranged substantially parallel and adjacent to the OLED.

4. The reflector pole according to claim 1, wherein each of the plurality of reflective micro structured surfaces forms a cube corner array.

5. The reflector pole according to claim 1, wherein the main body further comprises an electric storage device for supplying electrical power to the OLED.

6. The reflector pole according to claim 5, further comprising a photo voltaic device or a wind for providing an energy source for charging the electric storage device.

7. The reflector pole according to claim 5, wherein the main body further comprises a control unit for controlling at least one of the charging of the electric storage device or the power supply to the OLED in order to adjust at least the brightness or the colour of the emitted light.

8. The reflector pole according to claim 1, wherein the main body further comprises a proximity sensor for detecting at least one of approaching vehicles or pedestrians.

9. The reflector pole according to claim 1, wherein the main body further comprises at least one communication device for communicating with at least one of other reflector poles, vehicles, pedestrians, or external service devices.

10. The reflector pole according to claim 1, wherein the main body further comprises a light sensor for detecting day or night time in order to activate the OLED only in darkness.

11. A reflector pole according to claim 1, wherein the OLED is a bicolour or a multicolour OLED emitting at least a first colour on one side of the OLED and at least a second colour at an opposite side of the OLED.

12. A reflector pole used as a road boundary for road or pedestrian traffic, the pole comprising a main body having at least one light active field comprising a retro reflective compound including an organic light emitting diode (OLED) and a retro reflective membrane, wherein the retro reflective membrane is at transreflective and is arranged substantially parallel and adjacent to the OLED and wherein the OLED has a light outcoupling side, emitting light generated by the OLED, and wherein the retro reflective membrane is laminated onto said light outcoupling side.

13. The reflector pole according to claim 12, wherein the outcoupling side of the OLED comprises an electrode layer having a high reflective surface.

* * * * *